United States Patent [19]

Tanaka et al.

[11] 4,340,361

[45] Jul. 20, 1982

[54] APPARATUS FOR HEAT-TREATING CAST IRON PIPES

[75] Inventors: Yoshio Tanaka; Susumu Togawa, both of Takarazuka; Akinori Sakoda, Amagasaki, all of Japan

[73] Assignee: Kubota, Ltd., Osaka, Japan

[21] Appl. No.: 158,148

[22] Filed: Jun. 10, 1980

[30] Foreign Application Priority Data

Jun. 14, 1979 [JP] Japan ..... 54-75978

[51] Int. Cl.[3] ..... F27B 9/02; F27D 19/00

[52] U.S. Cl. ..... 432/128; 164/270.1; 266/142; 432/42; 432/62; 432/130; 432/133; 432/239

[58] Field of Search ..... 432/42, 62, 122, 124, 432/126, 128, 130, 133, 239; 266/142; 164/270.1

[56] References Cited

U.S. PATENT DOCUMENTS

| | | | |
|---|---|---|---|
| 1,471,659 | 10/1923 | Helander | 432/124 |
| 1,525,905 | 2/1925 | Anthony | 432/124 |
| 1,882,470 | 10/1932 | Assel | 432/122 |
| 2,167,821 | 8/1939 | Ackerman, Jr. et al. | 432/133 |

FOREIGN PATENT DOCUMENTS

| | | | |
|---|---|---|---|
| 2319093 | 7/1975 | France | 432/239 |

*Primary Examiner*—John J. Camby
*Attorney, Agent, or Firm*—Joseph W. Farley

[57] ABSTRACT

A heat-treating apparatus for practicing a method in which when red-hot iron pipes produced by a centrifugal casting machine are cooled, the pipes are slowly cooled over the temperature range of 800° to 700° C. to ferritize the pipes without separately annealing the pipes. A heat-treating furnace disposed close to one end of the rotary mold of the casting machine has furnace chambers each provided with pairs of rotatable rollers for supporting the pipe in rotation to prevent the deformation of the pipe. Each of the chambers has heating burners or a cooling heat exchanger for adjusting the temperature and cooling speed of the pipe placed in the chamber. According to a preferred embodiment, the furnace chambers are separated by openable partition members of circular-arc section, and each of the chambers has turnable levers for transferring the pipe to another chamber adjacent thereto.

9 Claims, 10 Drawing Figures

APPARATUS FOR HEAT-TREATING CAST IRON PIPES

The present invention relates to an apparatus for heat-treating cast iron pipes, and more particularly to a novel heat-treating apparatus for efficiently producing cast iron pipes of ferrite structure.

When ductile cast iron pipes produced by centrifugal casting are withdrawn from the rotary mold in a hot state and cooled in air as cast, the resulting structure has a high content of cementite or pearlite and is brittle. To give fully useful mechanical properties to such cast iron pipes, therefore, the pipe cooled nearly to room temperature is usually maintained, for example, at 950° C. for 1 to 2 hours in another heat-treating furnace and thereafter slowly cooled for ferritization by annealing.

However the conventional method of heat treatment in which the cooled pipe is reheated for annealing has the drawbacks of wasting a large amount of heat energy and being low in productivity. Additionally the furnace, when of the horizontal type, is large-sized and necessitates means for transferring cast iron pipes to the furnace. The heat-treating equipment therefore requires a large space and is costly.

To overcome these problems, the present applicant has already proposed a method in which an iron pipe cast in a non-chilled (cementite-free) condition is transferred from the mold directly to a furnace, in which the pipe is cooled at a rate of 2° to 10° C./min in the temperature range of 800° to 700° C. by controlling the rate of dissipation of the self-heat of the pipe, as disclosed in U.S. Pat. No. 3,954,133. As compared with the foregoing method in which the pipe is reheated for annealing after cooling, this method assures great savings in heat energy by conducting the heat treatment continuously with the casting step with use of the heat given to the pipe during casting. Nevertheless a heat-treating apparatus still remains to be provided by which this method can be practiced efficiently.

The present invention contemplates provision of a heat-treating apparatus which is well suited for practicing the efficient method described above. Specifically the main object of the invention is to provide a heat-treating apparatus comprising a heat-treating furnace which is adapted to receive cast iron pipes in a red hot state directly from a mold without the necessity of using large conveyor means and which is exceedingly compacter than conventional continuous treating furnaces and capable of continuously heat-treating the iron pipes without entailing the deformation of the pipes especially to an oval form.

To fulfill this object, the invention provides a heat-treating apparatus comprising a heat-treating furnace which is disposed close to a rotary mold and which has a plurality of furnace chambers arranged side by side in parallel to the axis of the mold, rotating means provided in each of the furnace chambers for supporting a cast iron pipe in rotation, and means for adjusting the temperature of the cast iron pipe accommodated in each of the furnace chambers.

With the construction described, the heat-treating furnace is divided into a plurality of chambers each of which is provided with temperature adjusting means, so that the furnace chambers can be set to temperatures with a required temperature difference from chamber to chamber to give a proper temperature curve with use of a small space and achieve an operation efficiency approximate to that of a continuous furnace. The cast iron pipe can be prevented from deforming, for example, to an oval form even at high temperatures since it is adapted to be rotated.

According to a preferred embodiment of the invention, the heat treating furnace is stationary and has furnace chambers separated by openable partition members and transfer means for transferring the cast iron pipe from one furance chamber to the next adjacent chamber, such that the pipe can be heat-treated along a predetermined temperature curve while being transferred from chamber to chamber. Because of this construction, the apparatus is simple in structure, almost as efficient as continuous furnaces and installable in as small a space as is needed for batchwise furnaces.

According to another preferred embodiment, the partition member comprises a door including a closure plate of circular-arc cross section turnable about the center of the circular arc. The inner surface of the ceiling of the furnace chamber also has a circular-arc cross section in conformity with the shape of the closure plate. With this arrangement, the furnace chambers can be partitioned effectively from one another to maintain the specified temperature difference between the adjacent chambers. Since the door is not provided through the ceiling of the furnace, the interior of the furnace can be completely sealed off, while the furnace can be of smaller height than when the partition member is of the vertically movable type. This renders the furnace compact and the interior temperature of the furnace chambers controllable with greater ease and accuracy to afford cast iron pipes of improved quality.

According to another embodiment of the invention, the heat-treating furnace is movable in directions at right angles with the axis of the rotary furnace, and cast iron pipes are placed into furnace chambers in succession, one into each chamber. The pipe in each chamber is heat-treated batchwise and thereafter withdrawn therefrom.

Various other features and advantages of the invention will become apparent from the following description of the embodiments with reference to the accompanying drawings, in which:

FIGS. 1*a* and 1*b* are plan views schematically showing the overall arrangement of centrifugal casting equipment incorporating a heat-treating apparatus of the invention according to a first embodiment, FIGS. 1*a* and 1*b* being continuous in alignment with each other and showing the same rotary mold;

Figure 1B:
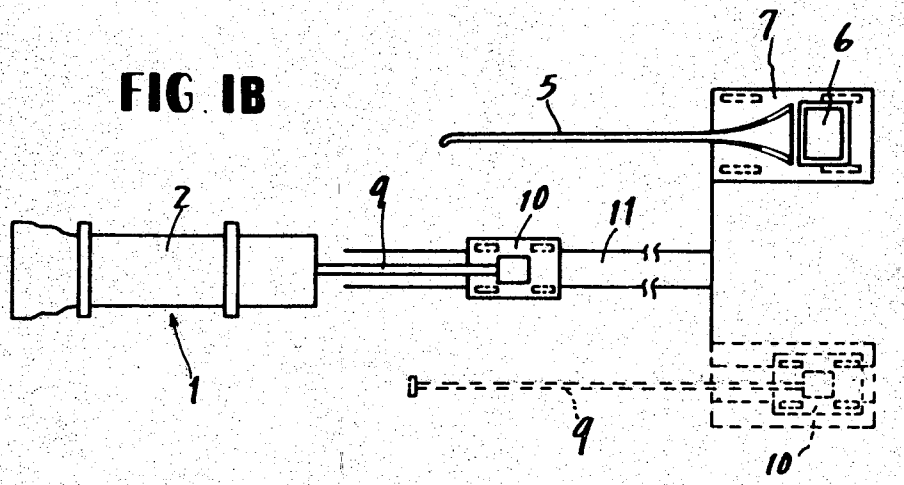
Figure 1A:
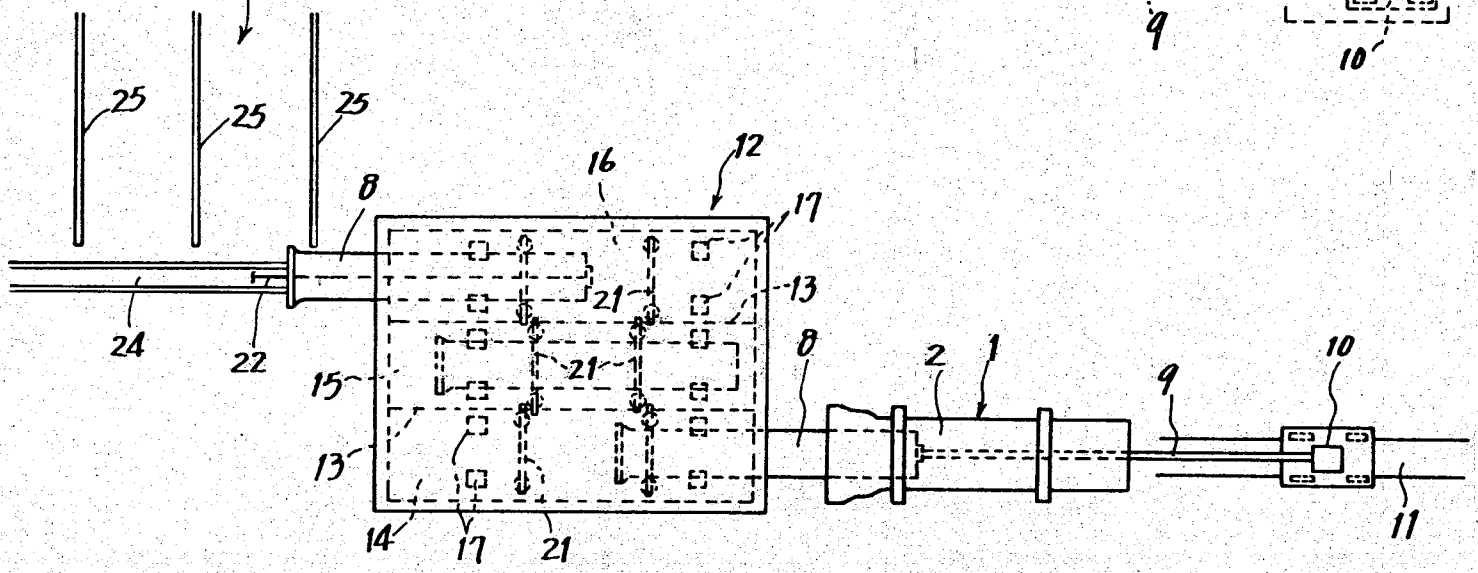
Figure 2:
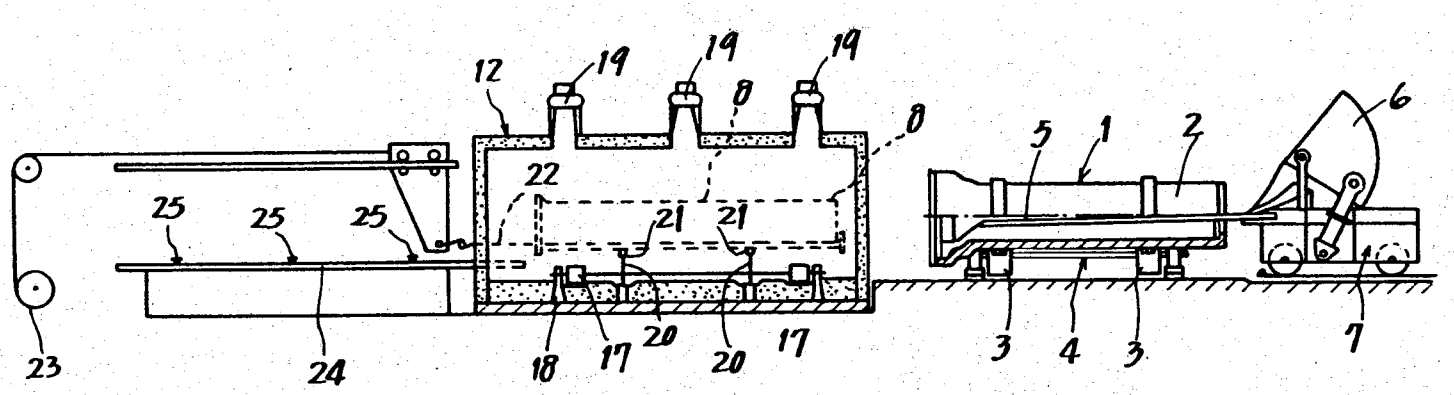
FIG. 2 is a side elevation partly in section of FIG. 1*a*, with the rotary mold shown during operation for centrifugal casting.

With reference to FIGS. 1*a*, 1*b* and 2, a centrifugal casting machine 1 comprises a rotary mold 2 usually lined with a refractory coating for the centrifugal casting of ductile iron pipes, and a rotating assembly 4 for driving the mold 3 in a fixed position with rotatable rollers 3. Disposed on one side of the machine 1 are a carriage 7 provided with a ladle 6 for pouring molten metal into the mold 2 with a trough 5, and a pusher carriage 10 fixedly provided with a pushing rod 9 for pushing out a cast iron pipe 8 in a red hot state from the mold 2 after the pipe has been solidified in the mold. These two carriages 7 and 10 are arranged side by side at the ends of rails 11 extending from the pouring side of the casting machine 1 and are alternately movable toward the machine 1.

The pipe 8 pushed out from the mold 2 by the pushing rod 9 is placed directly into a heat-treating furnace 12 disposed close to the outlet side of the casting machine 1. The furnace 12 is box-shaped and lined with a refractory such as ceramic fibers. The furnace 12 has in its interior ceramic fiber curtains 13 serving as partition members, suspended from the ceiling of the furnace and having a free lower end. In the illustrated embodiment, the partition members divide the interior of the furnace into a first furnace chamber 14 having a closable inlet (not shown) for cast iron pipes, a second furnace chamber 15 adjacent to the chamber 14 and a third furnace chamber 16 adjacent to the second chamber 15 and having a closable outlet (not shown) for pipes on one side of the furnace opposite to the inlet side thereof. These furnace chambers 14, 15 and 16 are arranged side by side at right angles to the axis of the mold 2. The first chamber 14 serves as an inlet chamber for the cast iron pipe 8 from the casting machine 1, i.e. the mold 2. The third chamber 16 is a terminal chamber from which the pipe 8 is withdrawn.

Although the interior of the furnace 12 of the present embodiment is divided into the three chambers 14 to 16, the number of the furnace chambers can be determined as desired. The partition member is not limited to the curtain 13 but can be any member insofar as the member renders a furnace chamber openable to the adjacent chamber when so desired. The use of the curtain is advantageous in that it is openable or closable without any particular procedure and that it is spontaneously returnable to the original position upon the passage of the pipe therethrough.

Each of the furnace chambers 14, 15 and 16 is provided with rotating means for supporting the pipe 8 in rotation and heating means for adjusting the temperature of the pipe within the furnace chamber directly, and/or indirectly in accordance with the ambient temperature in the chamber, to anneal the pipe for the desired ferritization. Thus the temperature adjustment is effected in each chamber individually. Means for transferring the pipe 8 from one chamber to another chamber adjacent thereto is provided at least in each of the first and second chambers 14 and 15.

Preferably the rotating means comprises two pairs of rotatable rollers 17 which are provided in the chamber as spaced apart longitudinally thereof and which are driven by a rotating assembly 18 fixed to the bottom of the furnace. The pipe 8 is horizontally supported on the rollers 17 and held in rotation in a fixed position. Preferably the heating means comprises burners 19 (not shown in FIG. 1*a*) mounted on the ceiling of the furnace at a suitable number of locations and exposed to the interior of the furnace for emitting heat toward the top of the pipe 8 if each of the chambers, whereby the temperature of the pipe 8 in the chamber is adjusted directly and indirectly in accordance with the ambient temperature. The temperature is adjustable in each chamber individually.

The means illustrated for transferring the pipe 8 within the furnace comprises two pairs of cylinder rods 20 adjustingly extensible upward from the floor of each furnace chamber and spaced apart longitudinally of the chamber. (The cylinder main bodies, which are not shown, are disposed outside the furnace.) The pair of opposed rods 20 are connected together at their upper ends with a rod 21. When the rods 20 are extended, the pipe 8 is liftable from the rollers 17 by being supported on the connecting rods 21 in a horizontal or inclined position. When the pipe is to be transferred within the furnace from one chamber to another chamber adjacent thereto, the rods 20 on one side of the chamber widthwise thereof are stretched to a higher level to raise the connecting rods 21 to an inclined position, causing the rods to push up the pipe at one side and allowing the pipe to roll into the next chamber. The pipe 8 is placed into the first chamber 14 from the casting machine 1 and withdrawn from the third chamber 16, with the connecting rods 21 lifted to a horizontal position above the rollers 17.

The rollers 17, cylinder rods 20 and connecting rods 21 installed in the furnace must be resistant to high temperatures. Preferably, therefore, the rollers 17 are each adapted to be cooled with water, while the rods 20 and 21 are coated with ceramic fiber or like refractory material. Since the rollers 17 are held in contact with the pipe 8 for a prolonged period of time, it is preferable that the outer peripheral wall thereof be lined with a heat insulating layer so as to assure a uniform temperature distribution over the outer surface of the pipe 8.

The pipe 8, when brought to the third chamber 16 by the transfer means, is subjected to heat treatment as specified and thereafter withdrawn from the furnace through its outlet by suitable means, such as a drawing member 22 engaged with one end of the pipe 8 and connected to a winch 23. The pipe 8 is placed onto rails 24 outside the furnace and then transferred onto a platform 26 provided with parallel rails 25. When withdrawn from the furnace, the pipe 8 has a greatly reduced temperature and will not deform, for example, to an oval shape.

Figure 7:
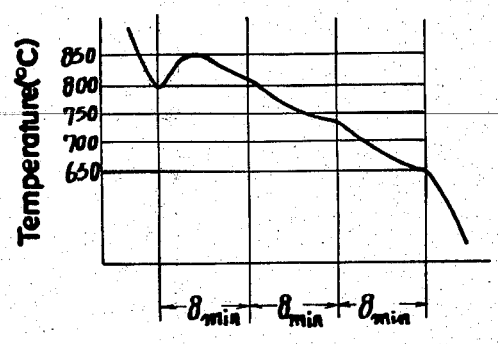
FIGS. 7 to 9 are graphs showing various cooling conditions for cast iron pipes.

With use of the heat-treating apparatus described above, a ductile cast iron pipe 8 will be annealed for ferritization in the following manner, for example, under the conditions shown in FIG. 7. The furnace is set to stepwise reduced ambient temperatures of 800° to 750° C. in the first chamber 14, 750° to 700° C. in the second chamber 15 and 700° to 650° C. in the third chamber 16. The cast iron pipe 8 produced by centrifugal casting with the machine 1 and having a temperature of 800° to 700° C. is fed to the first chamber 14 in a red hot state. While holding the pipe 8 in rotation by the rotating means, heat is emitted from the burners 19 against the top of the pipe 8 to heat the pipe 8 to about 850° C. The pipe 8 is thereafter allowed to cool in the first chamber 14 for a specified period of time. When the pipe 8 has been cooled to about 810° C. while being held in the chamber 14 for about 8 minutes, the pipe is transferred to the second chamber 15, in which the pipe is slowly cooled to about 730° C. over a period of about 8 minutes. The pipe 8 is then transferred to the third chamber 16, in which it is slowly cooled for about 8 minutes to 650° C. The pipe is thereafter withdrawn from the furnace. When thus heat-treated, the pipe 8 is slowly cooled at a rate of about 10° C./min around the $Ar_1$ transformation point (750° C.) thereof and is thereby fully ferritized, as effected by the conventional method of heat treatment in which pipes are reheated in a separate heat-treating furnace.

The results achieved by the heat treatment described above are as follows. The ductile cast iron pipe was 1000 mm in diameter, 6000 mm in length and 13.5 mm in wall thickness and had the composition of 3.4% C, 2.7% Si, 0.03% Mg and balance substantially Fe. When heat-treated under the conditions of FIG. 7, the pipe was ferritized 95% and had the mechanical properties of: 57 kg/mm$^2$ in tensile strength, 16% in elongation and 1.7 kg m/cm$^2$ in V-notch Charpy impact value. The amount of fuel oil consumed by the burners 19 for the annealing process was 20 liters/ton. This indicates a remarkable saving in energy since conventional annealing furnace require 50 to 70 liters/ton.

The example described above is given for illustrative purposes only; the temperature settings for the furnace chambers or heating temperatures for the pipe are variable in accordance with the composition of the pipe 8, the temperature of the molten metal to be cast, inoculation condition and other casting conditions. The chambers are set to the desired temperatures individually by the heating means or cooling means provided for each of the chambers.

The duration of the heat treatment in each furnace chamber, which is preferably in accordance with the capacity of the casting machine 1, can be determined as desired by varying the number of the chambers as already described.

While pearlite is decomposable to ferrite by the single-stage annealing operation described, the present apparatus can be adapted for two-stage annealing operation involving decomposition of cementite for graphitization and decomposition of pearlite for ferritization.

Figure 3:
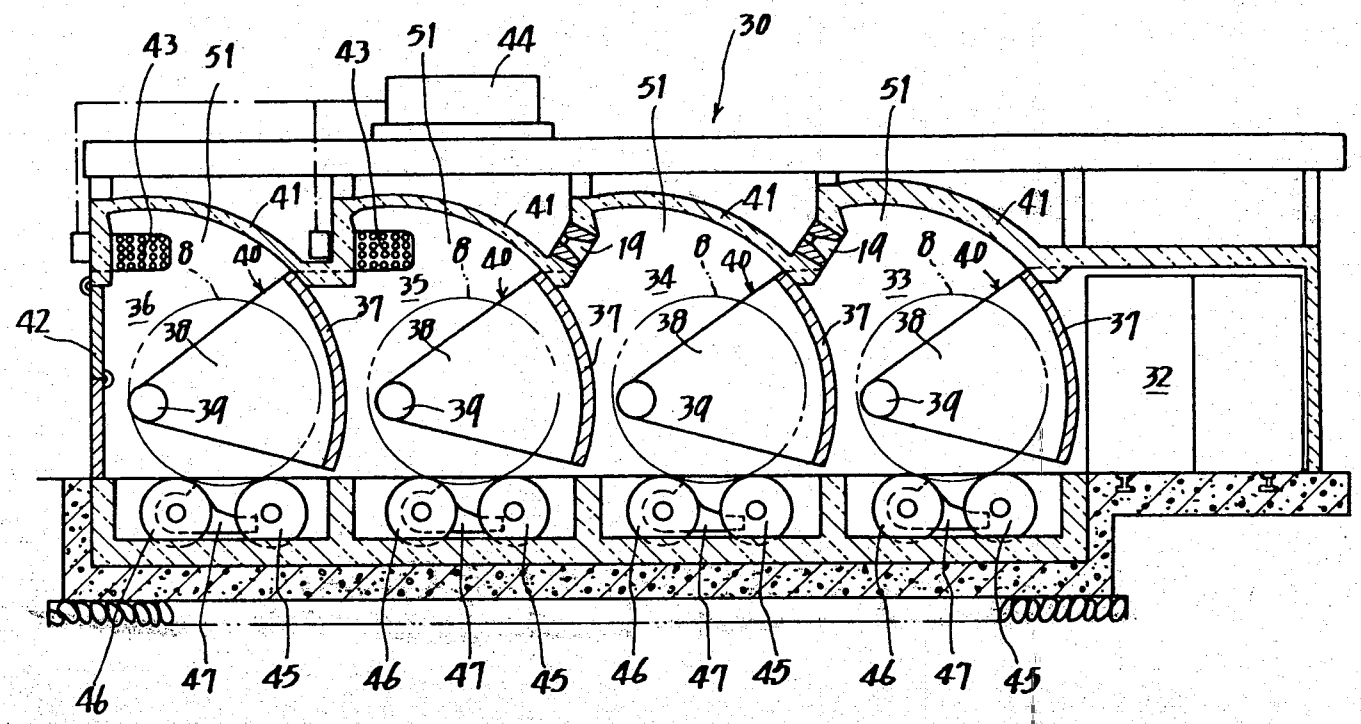
FIG. 3 is a front view in vertical section showing an improved heat-treating furnace.
Figure 4:
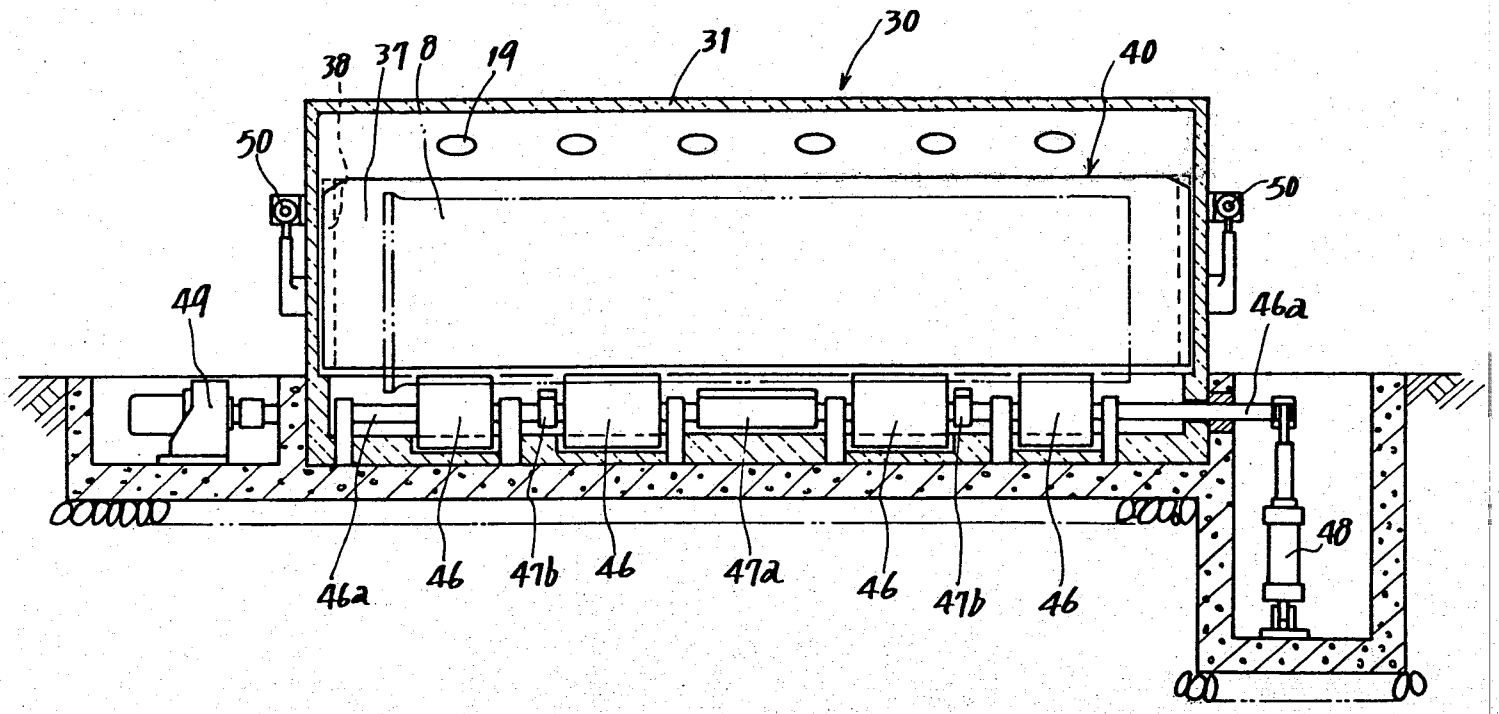
FIG. 4 is a side elevation in vertical section of FIG. 3.

With reference to FIGS. 3 and 4, a heat-treating furnace 30, an improvement over the furnace 12, will now be descirbed. A furnace body 31 has in its interior a plurality of (i.e. four in the illustrated embodiment) furnace chambers 33 to 36 arranged side by side. An inlet chamber 32 for receiving cast iron pipes 8 is provided adjacent to the first chamber 33. Each of the chambers 33 to 36 has an inlet opening which is closable with a door 40 which is upwardly or downwardly turnable and which has a closure plate 37 of circular-arc cross section. The door 40 has support frames 38 extending from both sides of the plate 37 toward the center of the circular arc and having pivots 39 at the center. The door 40 is turnably supported by the pivots on the side walls of the furnace body 31. The ceiling wall of each of the chambers 33 to 36 has an inner surface of circular-arc cross section along which the outer surface of the closure plate 37 is slidable. The last chamber 36 is provided at its outlet opening with a door 42 which is upwardly turnable. The front two chambers 33 and 34 are provided, each at an upper portion thereof, with burners 19, while the rear two chambers 35 and 36 are provided, each at an upper portion thereof, with heat exchangers 43 serving as cooling means. Both head exchangers 43 are connected to a cooling blower 44. Each of the chambers 33 to 36 has at a lower portion thereof drive rollers 45 and free rollers 46 serving as rotating means for supporting the pipe 8 in rotation. Means for transferring the pipe 8 comprises feed levers **47*a* and 47*b* fixed to a shaft 46*a* rotatably supporting the free rollers 46. To turn the transfer levers 47*a* and 47*b* and cause the levers to push the pipe 8 from behind, the shaft 46*a* is turnable by a cylinder assembly 48. Indicated at 49 is a drive motor for the drive rollers 45, and at 50 a cylinder assembly for driving the door 40**.

While cast iron pipes 8 are accommodated in the chambers 33 to 36 and subjected to the heat treatment specified for each chamber, the chambers are made completely independent of one another by the doors 40, with a temperature difference maintained between the chambers. Accordingly heat treatment can be conducted along a proper temperature curve even when the furnace body 31 has a small length in the direction of transfer of the pipe 8. Since the door 40 has the circular-arc closure plate 37 and is turnable, the door is positionable on the inside of the ceiling wall 41 when in its opened state, while the chambers 33 to 36 can be completely sealed off from outside to eliminate heat losses. Additionally, the closure plate 37 and the ceiling wall 41, which are circular arc in section, serve to provide a space of suitable size under the wall 41. This space is useful for effecting uniform heating or cooling with the burners 19 or heat exchanger 43. This also renders the furnace body 31 compact.

When pipes 8 are to be transferred from one chamber to another chamber adjacent thereto, the door 42 of the last chamber 36 is opened, and the pipe 8 in the chamber 36 is pushed out therefrom by the levers 47. After closing the door 42, the door 40 of the last chamber 36 is opened, and the pipe 8 in the chamber 35 immediately adjacent to the chamber 36 is brought into the chamber 36. The door 40 of the last chamber 36 is thereafter closed, while the door 40 of the chamber 35 is opened. In this way each two adjacent chambers only are opened to each other in succession for the transfer of the pipes 8. This enables the chambers 33 to 36 having varying temperatures to maintain the desired temperatures with reduced changes despite the transfer of the pipes 8. Since the pipes 8 can be transferred only by turning the doors 40 and operating the transfer levers 47, the furnace achieves as high a heat-treating efficiency as is attained by conventional continuous furnaces. The transfer of the pipes 8 is effected by controlling the cylinder assemblies 48 and 50 as associated with each other. For this purpose, the apparatus is provided with an unillustrated drive control system.

Figure 5:
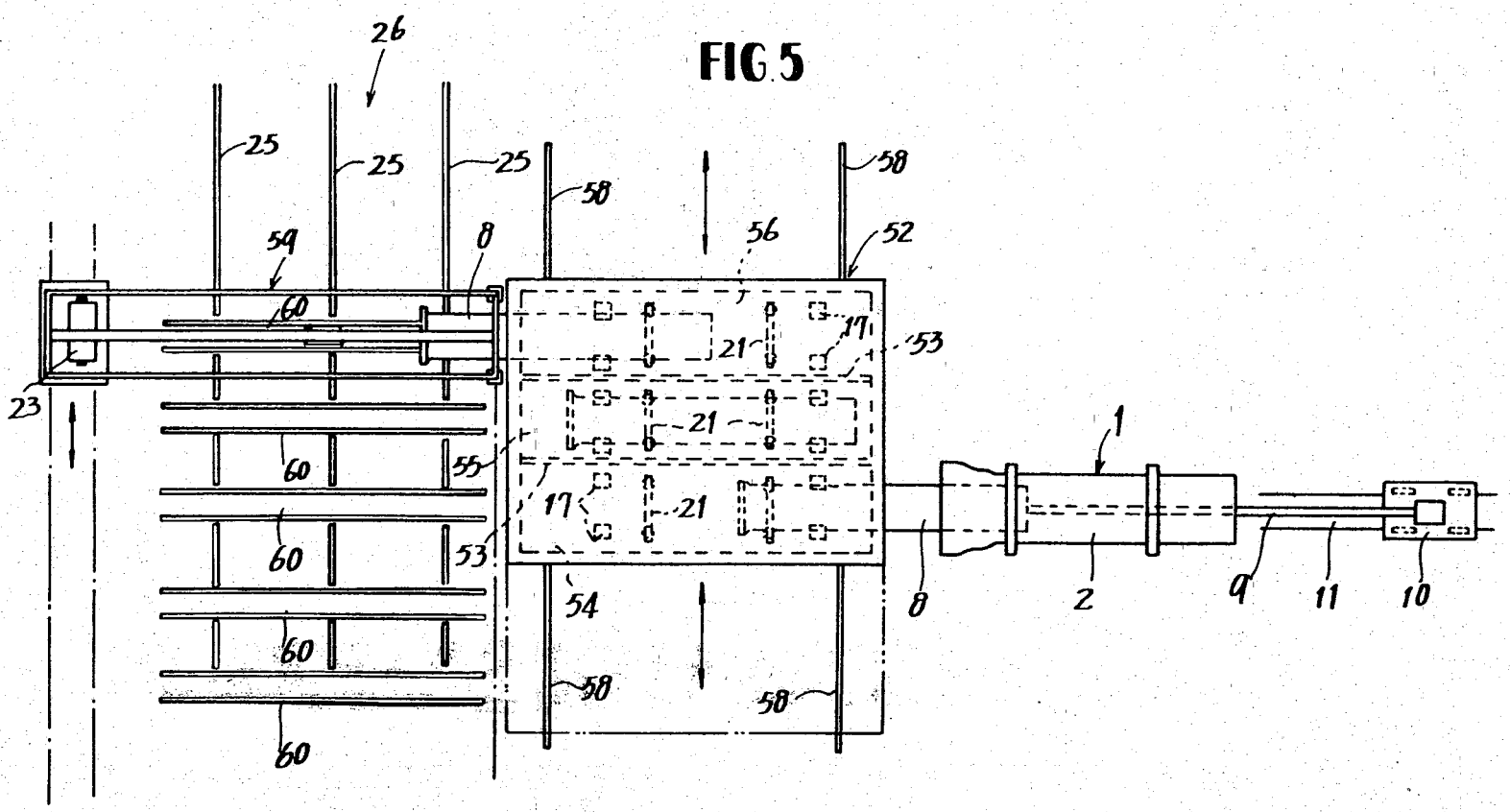
FIG. 5 is a plan view showing another heat-treating apparatus of the invention according to a second embodiment.
Figure 6:
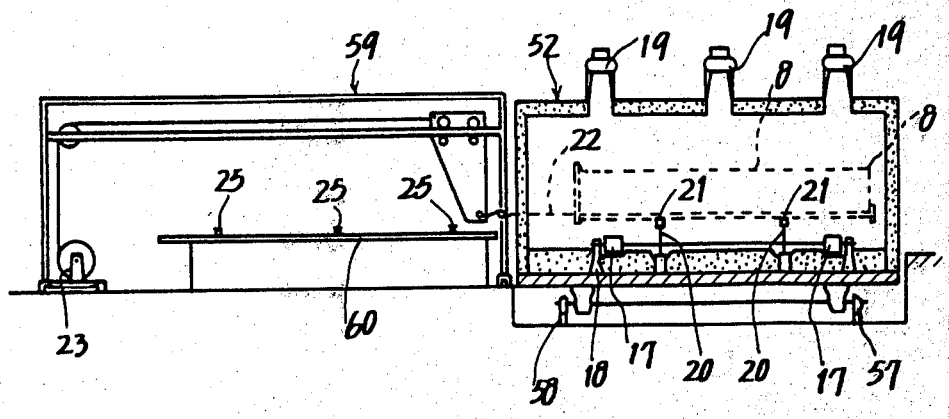
FIG. 6 is a fragmentary front view in vertical section showing the apparatus of FIG. 5.

A second embodiment of the invention will be described with reference to FIGS. 5 and 6. The second embodiment comprises a heat-treating furnace 52 in place of the furnace 12 of the first embodiment. The furnace 52 is movable in directions at right angles to the axis of the rotary mold. Like parts are referred to by like numerals and will not be described repeatedly. The furnace 52 is in the form of a box and is integrally provided with partition walls 53 which divide the interior of the furnace into three batchwise furnace chambers, namely, into a first chamber 54, a second chamber 55 and a third chamber 56. These chambers are arranged side by side in the direction of movement of the furnace. The furnace is provided with wheels 57 on its bottom and is movable on rails 58 extending at right angles to the axis of the rotary mold 2. Each of the chambers 54 to 56 is provided with closable inlet and outlet (not shown) for feeding and withdrawing the pipe 8. As in the case with the first embodiment, each of the chambers has in its interior means for rotating the pipe, temperature adjusting means and auxiliary transfer means 20 and 21 for facilitating the feed and discharge of the pipe 8.

On one side of the furnace 52 remote from the mold 2, there is provided an assembly 59 for withdrawing the pipe 8 after the pipe has been heat-treated in the chamber 54, 55 or 56. The withdrawing assembly 59 is movable in parallel to the direction of movement of the furnace 52 and has a drawing member 22 and a winch 23. Indicated at 60 are parallel guide rails which, when a furnace chamber is positioned as opposed to the mold 2, are positionable in opposed relation to the other chambers for supporting and guiding the pipe withdrawn from the chamber.

Figure 8:
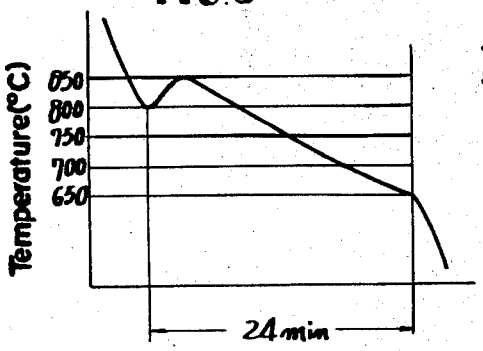

The pipe 8 cast in the rotary mold 2 is heat-treated in the following manner. The furnace 52 is moved to position the inlet of an empty chamber 54, 55 or 56 for the mold 2. The pipe 8, which has a temperature of 800° to 700° C. and in a red hot state, is placed into that chamber from the mold 2. The chambers have already been adjusted to predetermined ambient temperatures. As shown in FIG. 8, for example, the pipe 8 in the chamber is heated to about 850° C. with the burners 19, then slowly cooled at a rate of about 10° C./min to about 650° C. and subsequently withdrawn from the furnace through the outlet by the assembly 59. While the pipe 8 is being heat-treated in one chamber, the furnace is moved, and cast iron pipes 8 are fed from the mold 2 to the other chambers in succession for heat treatment. Accordingly under the usual operation condition in which the casting speed of the machine 1 exceeds the speed of heat treatment, pipes can be heat-treated satisfactorily concurrently with the operation of the machine 1.

For illustrative purposes, effects of heat treatment achieved by the second embodiment will be described. The pipes treated had the same dimensions as described above and the composition of 3.3% C, 2.8% Si, 0.03% Mg and balance substantially Fe. When heat-treated under the cooling conditions of FIG. 8, the pipes were ferritized 97% and had the mechanical properties of: 59 kg/mm$^2$ in tensile strength, 18% in elongation and 1.7 kg m/cm$^2$ in V-notch Charpy impact value.

Although the furnace 52 of the second embodiment comprises a single furnace body the interior of which is divided into the chambers 54 to 56, a plurality of independent batchwise heat-treating furnaces, each serving as a furnace chamber, may be assembled.

Figure 9:
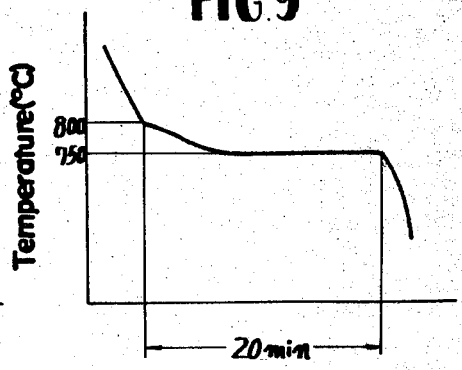

As another method of heat treatment with use of the apparatus of the invention, cast iron pipes 8 can be maintained at a substantially constant temperature of about 750° C. This method can be practiced with use of either one of the apparatus according to the first and second embodiments. For illustrative purposes, effects of heat treatment conducted by this method will be described. The ductile cast iron pipes treated had the same dimensions as already described and the composition of 3.4% C, 2.8% Si, 0.03% Mg and balance substantially Fe. When heat-treated under the cooling conditions of FIG. 9, the pipes were ferritized 94% and exhibited the mechanical properties of: 60 kg/mm$^2$ in tensile strength, 16% in elongation and 1.6 kg m/cm$^2$ in V-notch Charpy impact value.

What is claimed is:

1. In a system for manufacturing cast iron pipes comprising a rotary mold of the stationary type included in a centrifugal casting machine and a heat-treating furnace, the improvement wherein:

the heat-treating furnace is disposed close to the rotary mold for receiving red-hot cast iron pipes directly therefrom;

the furnace has a plurality of furnace chambers arranged side by side in parallel to the axis of the mold and partitioned by partition members provided between the chambers, each furnace chamber being adapted to accomodate and separately treat one cast iron pipe;

rotating means is provided in each of the furnace chambers for supporting and positively rotating the pipe in a fixed position; and means is provided for adjusting the temperature of the pipe accomodated in each of the furnace chambers, the temperature adjusting means comprising burners, disposed at least in the chamber for receiving a cast iron pipe from the mold, for emitting heat directly toward the top of the pipe.

2. A system as defined in claim 1 wherein the temperature adjusting means is provided with cooling means disposed at least in the furnace chamber through which the pipe is discharged from the furnace.

3. A system as defined in claim 1 wherein each of the partition members is a ceramic fiber curtain suspended from the ceiling of the furnace and having a free lower end, and means for transferring a pipe from one chamber to another chamber immediately adjacent thereto.

4. A system as defined in claim 1 wherein each of the partition members is a shutter, means for opening and closing the shutter, and means for transferring a pipe from one chamber through the open shutter to the chamber immediately adjacent to said one chamber.

5. A system as defined in claim 4 wherein each shutter comprises a door including a closure plate of circular-arc cross section for closing an inlet opening of said adjacent chamber and turnable about the center of the circular arc, and said one furnace chamber has a ceiling wall with an inner surface of circular-arc cross section substantially adapted for contact with the outer surface of the closure plate.

6. A system as defined in claim 3 or 4 wherein the rotating means comprises pairs of rollers rotatable on a pair of axes in parallel to each other, one of each pair of the rollers being a drive roller and the other of the pair being a free roller, a shaft rotatably supporting the free rollers, and the transferring means comprises levers secured to the shaft and means for rotating the shaft.

7. A system as defined in claim 1 wherein the rotating means comprises pairs of rollers rotatable on a pair of axes parallel to each other, and one of each pair of the rollers is a drive roller, the other of the pair being a free roller.

8. A system as defined in claim 7 wherein the transferring means comprises levers secured to a shaft rotatably supporting the free rollers and means for rotating the shaft.

9. A system as defined in claim 1 wherein the heat-treating furnace is movable in directions at right angles to the axis of the rotary mold, and the furnace chambers are defined by fixed walls provided between the chambers and forming said partition members.

* * * * *